US006035622A

United States Patent [19]

Fox et al.

[11] Patent Number: 6,035,622

[45] Date of Patent: Mar. 14, 2000

[54] METHOD AND APPARATUS FOR DETERMINING THE CHANGES IN CRITERIA OF AN AUTOMATIC PIECING OPERATION

[75] Inventors: Hermann-Josef Fox, Mönchengladbach; Manfred Lassmann, Nettetal, both of Germany

[73] Assignee: W. Schlafhorst AG & Co., Moenchengladbach, Germany

[21] Appl. No.: 07/763,625

[22] Filed: Sep. 23, 1991

[30] Foreign Application Priority Data

Sep. 22, 1990 [DE] Germany ..... 40 30 100

[51] Int. Cl.[7] ..... D01H 13/26

[52] U.S. Cl. ..... 57/263; 57/264

[58] Field of Search ..... 57/263, 264, 265, 57/404, 408, 409

[56] References Cited

U.S. PATENT DOCUMENTS

| | | | |
|---|---|---|---|
| 4,712,367 | 12/1987 | Lassman | 57/263 |
| 4,821,502 | 4/1989 | Bursek et al. | 57/263 |
| 4,825,631 | 5/1989 | Raasch | 57/263 |
| 4,825,632 | 5/1989 | Raasch et al. | 57/263 X |
| 4,891,933 | 1/1990 | Raasch | 57/263 X |
| 4,893,462 | 1/1990 | Braun et al. | 57/263 X |

FOREIGN PATENT DOCUMENTS 3716728 12/1988 Germany .

*Primary Examiner*—Michael R. Mansen

*Attorney, Agent, or Firm*—Herbert L. Lerner; Laurence A. Greenberg; Werner H. Stemer

[57] ABSTRACT

In a method and apparatus for determining a variation in criteria, parameters and/or command values of an automatic piecing operation at an automatic piecing apparatus of an automatic spinner, a piecer and/or a length of thread in which the piecer is located is measured in accordance with criteria of diameter or diameter per unit of length and evaluated for improving the piecer, with at least one sensor disposed in a thread travel path, upon resumption of winding after a piecing operation in which a spun yarn is received. A piece of thread containing the piecer is scanned by measuring with the at least one sensor in terms of location of thick and/or thin places with respect to the piecer at defined measurement points, as further criteria of the piecing operation. The measured data are continuously input into event counters connected downstream of the at least one sensor. In the event counters or in a measured value processing device associated with event counters, variously profiled thick and/or thin places and/or the location of the places with respect to the piecing and/or the specific sequences of thick and thin places are defined as special events and/or evaluated and separately counted. The result of counting is stored in memory, recorded and/or output and is used as a basis for varying the criteria, parameters and/or command values of future automatic piecing operations.

18 Claims, 5 Drawing Sheets

METHOD AND APPARATUS FOR DETERMINING THE CHANGES IN CRITERIA OF AN AUTOMATIC PIECING OPERATION

BACKGROUND OF THE INVENTION

1. Field of the Invention

The invention relates to a method and an apparatus for determining a variation in criteria, parameters and/or command values of an automatic piecing operation at an automatic piecing apparatus of an automatic spinner, in which a piecer and/or a length of thread in which the piecer is located upon a resumption of winding after a piecing operation in which the spun yarn is received, is measured in accordance with a criteria of diameter or diameter per unit of length and is evaluated with a view to improving the piecer, with at least one sensor disposed along the thread travel.

2. Description of the Related Art

A method and an apparatus for monitoring piecers in an open-end spinning system are known, for instance, from U.S. Pat. No. 4,825,632 to Raasch et al. In the length of thread that contains the piecer, the diameter values are measured relative to the longitudinal axis of the thread, stored electronically in memory in an apparatus, and compared with comparison values in a comparator in that device. The comparison is used to purposely derive options for intervention in order to improve future piecers in an apparatus connected to the output side. The apparatus includes a device for metering quantities of piecer fibers, which determines the on time of a switch of a sliver draw-in device for producing the next piecer based on the result of a comparison, so that a suitable quantity of fiber can be pre-stored in a rotating fiber collector. Average values formed in an average former from various measurements can be used for comparison.

However, the criteria used and the variation thereof are not adequate for quickly and reliably finding the advantageous piecer profile for the most varied types of yarns and fiber materials, or even for attaining good piecing results that vary within desirably narrow limits.

SUMMARY OF THE INVENTION

It is accordingly an object of the invention to provide a method and an apparatus for determining the changes in criteria of an automatic piecing operation, which overcome the hereinafore-mentioned disadvantages of the heretofore-known methods and devices of this general type, which create a precondition for automatic production of good piecers within close tolerance limits, and which optimize automatic piecing within the scope of what is possible.

With the foregoing and other objects in view there is provided, in accordance with the invention, a method for determining a variation in criteria, parameters and/or command values of an automatic piecing operation at an automatic piecing apparatus of an automatic spinner, in which a piecer and/or a length of thread in which the piecer is located is measured in accordance with criteria of diameter or diameter per unit of length and is evaluated for improving the piecer, with at least one sensor disposed in a thread travel path, upon resumption of winding after a piecing operation in which a spun yarn is received, a piece of thread containing the piecer is scanned by means of measurement technology by the at least one sensor in terms of the location of thick and/or thin places with respect to the piecer at defined measurement points, as further criteria of the piecing operation; the measured data are input continuously into following event counters; in the event counters or in a measured value processing device associated with the event counters, variously profiled thick and/or thin places and/or their location with respect to the piecer and/or their specific sequences of thick and thin places, are defined as special events and/or evaluated and counted separately; and that the result of counting is stored in memory, recorded and/or output and used as a basis for variation of the criteria, parameters and/or command values of future automatic piecing operations.

Furthermore, the automatic piecing can continue to be performed as before, for instance in accordance with U.S. Pat. No. 4,825,632. For instance, the piecers being produced can be compared afterward with the various counter results, and if the piecer quality is inadequate, then criteria, parameters and/or command values, such as setting data for the automatic spinning apparatus for future piecing operations of the same batch can be varied based on the counter results. This may be done manually. These variations apply, for instance, to the yarn draw-off speed and to the beginning of draw-off with respect to the rotor run-up characteristic curve, the sliver draw-in speed, which affects the draft and thus the fineness, the variation in the draw-in speed of the pre-storage of fiber in a rotor spinning unit, the variation of the dwell time of a thread returned to the rotor for piecing and the returned length of thread, and the variation of an adding up of the draw-in at the beginning of sliver draw-in for a spinning operation. Setting of the event counter itself can be varied manually, based on the counter results or on a printed record, for instance, with a view to defining the variously profiled thick and thin places and with a view to the various successions of thick and thin places, so as to arrive finally at high-quality piecers, perhaps after repeated readjustment.

However, the setting variations mentioned above can also be performed automatically and these setting variations can also be recorded continuously, or derived retroactively from the record of counter results. After some time, extensive statistical material for improving piecing for the various types of yarn and fiber, yarn fineness and machine characteristics can thus be attained in this way.

In accordance with another mode of the invention, there is provided a method which comprises linking the events together in a computer associated with the measured value processing device of the event counter, in such a way that from the results of the linking, depending on the type and/or severity and/or frequency of one event in comparison with the type and/or severity and/or frequency of other events, indications for the variation of the criteria of the piecing operation and/or for the variation of the command values or limit values result; and these indications are output in useful form with the aid of an output unit connected to the computer and/or are converted into variations of the further criteria or their command values within predetermined limits.

The interpretation of the counter results on the part of the user can thus be largely eliminated. The user receives either specific indications as to the type and magnitude of the command value variations, for instance in printed form, or variations in the criteria, parameters or command values are, for instance, simultaneously performed automatically.

In accordance with a further mode of the invention, there is provided a method which comprises detecting at least one working step characteristic for the piecing operation with a sensor as a further criterion of the piecing operation, where the measured data of this sensor are entered in an event counter or the measured value processing device or the associated computer and used for evaluating the special events.

For instance, in a rotor spinning machine, one such further criterion is the run-up of the rotor, or its acceleration during the run-up. The severity of an event can be evaluated differently, for instance, depending on the rotor run-up speed. A rotor that runs up abnormally slowly, like a rotor that runs up abnormally quickly, can lead to poor piecers, even under otherwise advantageous conditions, and this must be taken into account in evaluating the events so that this piecing operation will, for instance, be interpreted carefully, or precluded entirely on the basis of the interpretation.

In accordance with a further mode of the invention, there is provided a method which comprises evaluating the special criteria in the computer in order to ensure that an analysis of possible malfunctions or defects will be performed in accordance with a suitable, predetermined analysis program for analyzing the events, the malfunctions or defects are automatically weighted in accordance with their severity and/or possible causes of malfunction or defect and, based on the defect analysis, proposals for overcoming the malfunction or defect are additionally automatically ascertained and output.

Machine-dictated defects or malfunctions, material-dictated defects or malfunctions, and operationally dictated defects or malfunctions are possible.

Machine-dictated defects are, for instance, wear phenomena in rotors, opening cylinders, and draw-off and feed devices; material-dictated defects are, for instance, sliver or roving discontinuities, wrong fibers in the roving or in the yarn, or contamination in the fiber material or yarn. Operationally dictated defects or malfunctions are, for instance, the appearance of firmly attached dirt, or dirt that breaks away from time to time, in opening devices, fiber delivery devices, and spinning devices, such as rotors. These defects can often be eliminated by cleaning after shutting off the spinning apparatus.

In accordance with a further mode of the invention, there is provided a method which comprises ascertaining a succession of possible causes of malfunction or defect for each defect or each malfunction; for each ascertained possible cause of malfunction or defect, one or more proposals for overcoming the malfunction or defect is weighted in terms of its likelihood of success and/or in terms of the expense it entails for material, engineering, labor and/or time; and a list of the possible malfunctions or defects and/or proposals for overcoming the malfunction or defect, which is ordered in accordance with this weighting, is automatically output by the computer.

Since the aforementioned malfunctions or defects usually lead to the automatic shutoff of the spinning apparatus because of yarn breakage or because yarn tolerances are exceeded, it is advantageous to localize the defects or malfunctions that arise as quickly as possible and to eliminate them. This is also intended to be made easier by the invention.

With the objects of the invention in view, there is also provided an apparatus for determining the variation of criteria, parameters and/or command values of an automatic piecing operation in an automatic piecing apparatus of an automatic spinner, in which a piecer and/or a length of thread in which the piecer is located are measured by a criteria of diameter or diameter per unit of length and evaluated in terms of the improvement of future piecers, upon a resumption of a winding operation receiving a spun yarn after a piecing operation, with at least one sensor disposed in a thread travel path, the at least one sensor transmitting its measurement data to event counters, with which a measured value processing device, equipped with a computer and at least one memory, among other elements, is associated; the measurement limits of the event counters being set by command value setters, counters are provided for variously profiled thick and/or thin places and/or for various sequences of thick and thin places and for the location of the thick and/or thin places with respect to the piecing; the counter results of the event counters are stored in memory separately and upon being called up are displayed in the form of special events of the piecing operation or of piecing operations that have elapsed previously, in a display unit connected to it, and/or are used in a piecing computer connected to it, as the basis for possibly necessary variations, for improving the piecers, and the criteria, parameters and/or command values of future automatic piecing operations.

In accordance with another feature of the invention, the measured value processing device and/or the computer for linking the ascertained events is programmed in such a way that from the results of the linking, indications for varying the criteria of the piecing operation and/or for varying the parameters or command values result in accordance with the type and/or severity and/or frequency of one event in comparison with the type and/or severity and/or frequency of other events.

In accordance with a further feature of the invention, the run-up behavior of a spinning apparatus of the automatic spinner is detected by a sensor; the sensor is connected to the measured value processing device; and the measured value processing device and/or the computer is programmed in such a way that the measured data on the run-up behavior being received are used for evaluating the special events. For instance, a conclusion can be drawn from the run-up behavior of the spinning rotor, as to the beginning of the thread draw-off and from that as to the arrival of the piecer at the sensor and thus as to the location of the thick and/or thin places, or their distance from the piecer.

In accordance with an added feature of the invention, there is provided an external computer connected to the event counter or to the measured value processing device which takes on at least some of the computer functions of the measured value processing device. An external computer can be advantageous especially if it is already present in a spinning machine or in a group of spinning machines.

In accordance with an additional feature of the invention, the computer has an analysis program for analyzing the ascertained events with respect to possible defects or malfunctions of the piecing apparatus or of the piecing operation; and in the same program or some other program the weighting of the malfunctions or defects in accordance with their severity and/or their possible cause and the ascertainment and output of proposals for overcoming the malfunction or defect on the basis of the defect analysis are provided.

In accordance with yet another feature of the invention, the program of the computer provides for the ascertainment of a succession of possible sources of malfunction or defect, the preparation of proposals for overcoming the malfunction or defect, and the output of a list of proposals for overcoming the malfunction or defect in accordance with the likelihood of success.

In accordance with yet a further feature of the invention, the weighting of the likelihood of success of overcoming the malfunction or defect in accordance with the expense it entails for material, engineering, labor and/or time is contained in the program of the computer.

In accordance with a concomitant feature of the invention, the computer contains a preprogrammed expert system with a data bank and a knowledge base, wherein the knowledge base can be optimized, expanded, and checked by experts. The expert system interprets the data received by the event counter. The output of the event counter can be written manually or advantageously automatically in the computer or the data bank.

Other features which are considered as characteristic for the invention are set forth in the appended claims.

Although the invention is illustrated and described herein as embodied in a method and an apparatus for determining the changes in criteria of an automatic piecing operation, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
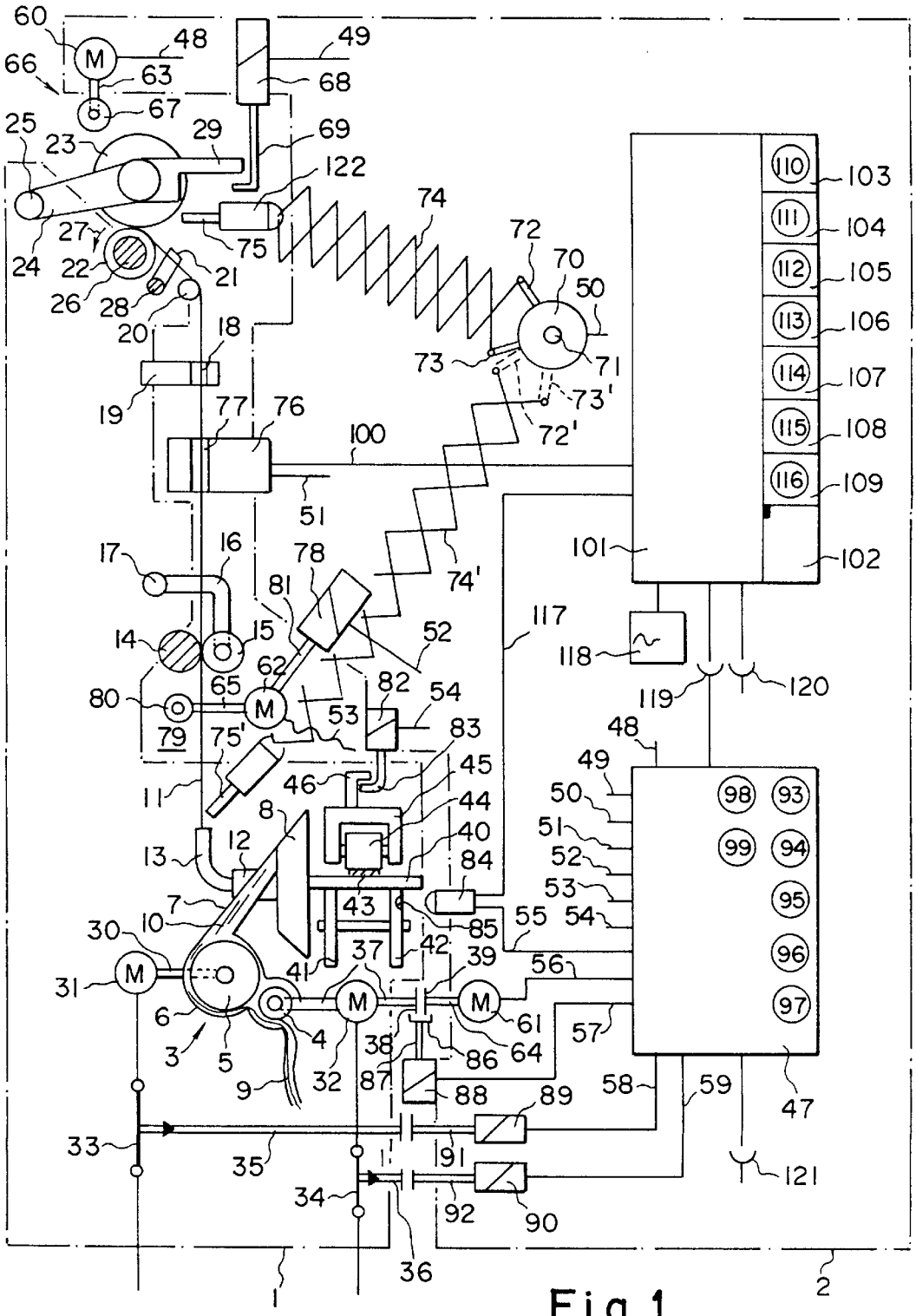
FIG. 1 is a diagrammatic and schematic view of an automatic spinner, in front of which an automatic piecer apparatus has arrived in position and is ready for operation.

Referring now to the figures of the draw-in in detail and first, particularly, to FIG. 1 thereof, there is seen an open-end spinning machine having a plurality of automatic spinners 1, disposed side by side in one row. The outline of the housing of the automatic spinner 1 is indicated by a phantom line. An automatic piecer apparatus 2 has already arrived, ready for operation, in a position in front of the automatic spinner 1. The outline of the housing of the piecer apparatus 2 is likewise represented by a phantom line.

The automatic spinner 1 includes an opening device 3 having a draw-in roller 4 and an opening cylinder 5. A housing 6 of the opening apparatus 3 merges with a fiber conduit 7, which discharges into a spinning device 8 that is constructed in this case as a spinning rotor.

The slowly rotating draw-in roller 4 delivers a sliver 9 to the opening cylinder 5, which rotates at high speed. The opening cylinder 5 combs single fibers and small groups of fibers out of the sliver 9. Fibers 10 pass through the fiber conduit 7 to reach the interior of the spinning rotor 8, which is under a vacuum. There, the spinning fibers are collected in an annular groove to make a fiber ring, which is continuously deformed into a thread. A thread 11 leaves the spinning rotor 8 through a draw-off nozzle 12 and a bent draw-off tube 13. The thread 11 is continuously drawn off out of the spinning device 8 at a predetermined draw-off speed through the use of a pair of draw-off rollers 14, 15.

The pair of draw-off rollers includes a centrally driven draw-off roller 14 that is guided along the machine, and a contact roller 15 resting against the thread 11 and the draw-off roller 14. The contact roller 15 is rotatably supported on a bracket 16.

The bracket 16 can be pivoted about a pivot shaft 17. The type of suspension of the contact roller 15 dictates that it rests on the draw-off roller 14 under the influence of gravity.

Farther upward, the thread 11 passes through a measurement foot 18 of a cleaner 19. The thread 11 travels in a thread travel path from the cleaner 19, past a guide rod 20, a traversing thread guide 21 and a take-up roller 22, and onto a cross-wound bobbin or cheese 23.

The cheese 23 is rotatably supported in a bobbin creel 24. The bobbin creel 24 is pivotable about a pivot shaft 25.

The take-up roller 22 is seated on a take-up shaft 26. The take-up shaft 26 is guided along the machine, it is driven centrally and it rotates in the direction of an arrow 27. The traversing thread guide 21 is driven by a traversing rod 28, which is guided along the machine, is centrally driven and traverses in the longitudinal direction.

In order to occasionally lift the cheese 23 from the take-up roller 22, the creel 24 is provided with an extension 29.

The opening cylinder 5 is connected to a shaft 30 of a drive motor 31. The supply of electrical power to the drive motor 31 is through a switch 33, which is normally closed but can be opened by loading a mechanical switch element 35.

There are other drive options for opening cylinders as well. However, for the sake of simplicity, an individual electrical drive has been selected in this exemplary embodiment.

The draw-in roller 4 is driven by a drive motor 32 which has a shaft 37 that extends out of the motor on both ends. On one end, it carries the draw-in roller 4 and on the other a clutch disk 38.

The supply of electrical power to the drive motor 32 is through a switch 34, which is normally closed. However, it can be opened by loading a switch element 36.

A shaft 40 of the spinning device 8 is supported from below by pairs of support disks 41, 42. The shaft 40 is driven from above by a tangential belt 43. During this process, billy or contact rollers 44, which are rotatably supported in a yoke 45, load the tangential belt 43 in such a way that it rests on the shaft 40 with the necessary contact pressure.

The tangential belt 43 is guided along the machine and it is centrally driven.

In order to occasionally lift the tangential belt 43 from the shaft 40, the yoke 45 is provided with a hook-like extension 46.

The automatic piecer apparatus 2 is disposed in such a way that it can be moved along the spinning machine from one automatic spinner to another. The automatic piecer apparatus 2 has a piecing computer 47 as its central control device, which is connected by operative connections 48 to 59 to various devices serving the purpose of piecing.

The operative connection 48 leads to a drive motor 60 of a bobbin drive device 66. A shaft 63 of the motor 60 is connected to a drive roller 67 of the bobbin drive device 66. Through the use of the piecing computer 47, the motor 60 can be set for a standstill, or for a counterclockwise or clockwise operation.

The operative connection 49 is connected to a creel lifter 68, which is constructed as an electromagnetic drive mechanism. The creel lifter 68 has a switch rod 69 which hooks under the extension 29 of the creel 24 in order to lift the creel. The operative connection 50 is connected to a controllable thread return device 70, which is pivotable about a pivot point 71 by means of a built-in stepping motor. At the same time, control arms 72, 73 move to positions 72', 73'. The control arms 72, 73 carry shears 74, which can be moved to a position 74' by the pivoting of the thread return device 70 and its control arms 72, 73. The shears have a thread receiver 75, which can be placed in front of the cheese 23 for thread take-up and in front of the draw-off tube 13 for thread output, by means of the shears 74.

The operative connection 51 leads to a sensor 76, having a measurement slit 77 in which the thread 11 is located. The sensor 76 is capable of continuously issuing signals that correspond to the applicable thread diameter at the measurement point.

The operative connection 52 leads to an electromagnetic drive mechanism 78 of a draw-off device which is identified overall by reference numeral 79. The draw-off device 79 includes a drive motor 62 having a shaft 65 which carries a draw-off roller 80. The motor 62 is supported by a control rod 81 of the electromagnetic drive mechanism 78. In the position shown in FIG. 1, the draw-off device 79 is not in operation.

The operative connection 53 is connected to the drive motor 62 of the draw-off device 79.

The operative connection 54 is connected to a switch device 82, which serves to turn the spinning rotor drive on and off. The switch device 82 includes an electromagnetic drive mechanism having a switch rod 83 which hooks behind the extension 46 of the yoke 45 in order to lift it.

The operative connection 55 transmits counting pulses from a sensor 84 to the piecing computer 47. The sensor 84 is a reflex photoelectric barrier, which responds to a reflector 85. The reflector 85 is located on a support disk 42, which is driven by the rotor shaft 40 as long as the rotor 8 is running.

The operative connection 56 connects a drive motor 61 to the piecing computer 47. The motor 61 has a shaft 64 that is provided with a clutch disk 39, which faces the clutch disk 38 of the drive motor 32. Through the use of a clutch apparatus 86, the two clutch disks 38 and 39 can be pressed together, whereupon the motor 61, instead of the motor 32, can take on the task of driving the draw-in roller 4. The clutch apparatus 86 is located on a switch rod 87 of an electromagnetic drive mechanism 88, which is connected to the piecing computer 47 by means of the operative connection 57.

The operative connections 58 and 59 lead to switch devices 89 and 90, which are constructed as electromagnetic drive mechanisms, having switch rods 91, 92 which are capable of actuating the respective switches 33 and 34.

Settings can be carried out manually and displayed at command value setters 93 to 99. The operating rpm of the rotor is set at the command value setter 93, the draw-off speed at the command value setter 94, the rotor diameter at the command value setter 95, the operating draw-in speed at the command value setter 96, the prefeeding draw-in speed at the command value setter 97, the dwell time of the returned thread in the rotor until the moment of thread draw-off at the command value setter 98, and the adding up of the feeding in the run-in phase is set at the command value setter 99.

The sensor 76 also transmits its measurement data over a line 100 to event counters 103 to 109 of a measured value processing device 101, which is equipped with a non-illustrated computer and a memory 102, among other elements. The event counters are equipped with non-illustrated counting devices and measuring channels. The measurement limits of the measuring channels can be set by means of command or set point value setters, of which command value setters 110 to 116 are shown in FIG. 1.

The counter 103 is provided for detecting and counting short thick places, and the counter 104 is provided for detecting and counting long thick places. The counter 105 is provided for detecting and counting short thin places, and the counter 106 is provided for detecting and counting long thin places. The two counters 107 and 108 are provided for detecting and counting different sequences of thick and thin places, and specifically the counter 107 is used for the sequence of thick-thin-thick places, wherein the first thick place appears at the piecer, and the counter 108 is used for some other order. The counter 109 is provided for detecting rotor acceleration upon run-up of the spinning rotor 8. The thick and thin places being detected are additionally detected in terms of their position in the thread travel direction to a piecer 126 shown in FIG. 2, and their frequency at certain positions is counted in event counters and optionally evaluated. The aforementioned counters can advantageously detect the events in accordance with the following classification:

a) events that are located upstream of the piecer 126;

b) events that at a length of one times the rotor groove circumference pertain to the piecer itself;

c) events that occur immediately downstream of the length of b); and d) events that occur farther downstream of the piecer.

In order to detect the rotor rpm, the sensor 84 is connected by an operative connection 117 to the measured value processing device 101, to which an output unit 118 is connected. An interface 119 connects the device 101 to the piecing computer 47. A further interface 120 is provided for connecting the device 101 to an external computer. An interface 121 for connection with an external computer is also provided on the winding station computer 47.

The piecing computer 47 contains a complete piecing program. In accordance with the program, the computer 47 controls the following working steps:

First, the switch device 89 extends the switch rod 91 to open the switch 33, and at the same time the switch device 90 extends the switch rod 92 to open the switch 34. The motors 31 and 32 remain stopped, and after that neither sliver draw-in nor further opening of the sliver into individual fibers is possible. Once the opening cylinder 5 stops, the computer 47 brings about cleaning of the spinning device 8, in a manner which is not shown herein. Dirt particles may have collected and stuck there. Cleaning also serves to eliminate any fibers that are still present.

Figure 2:
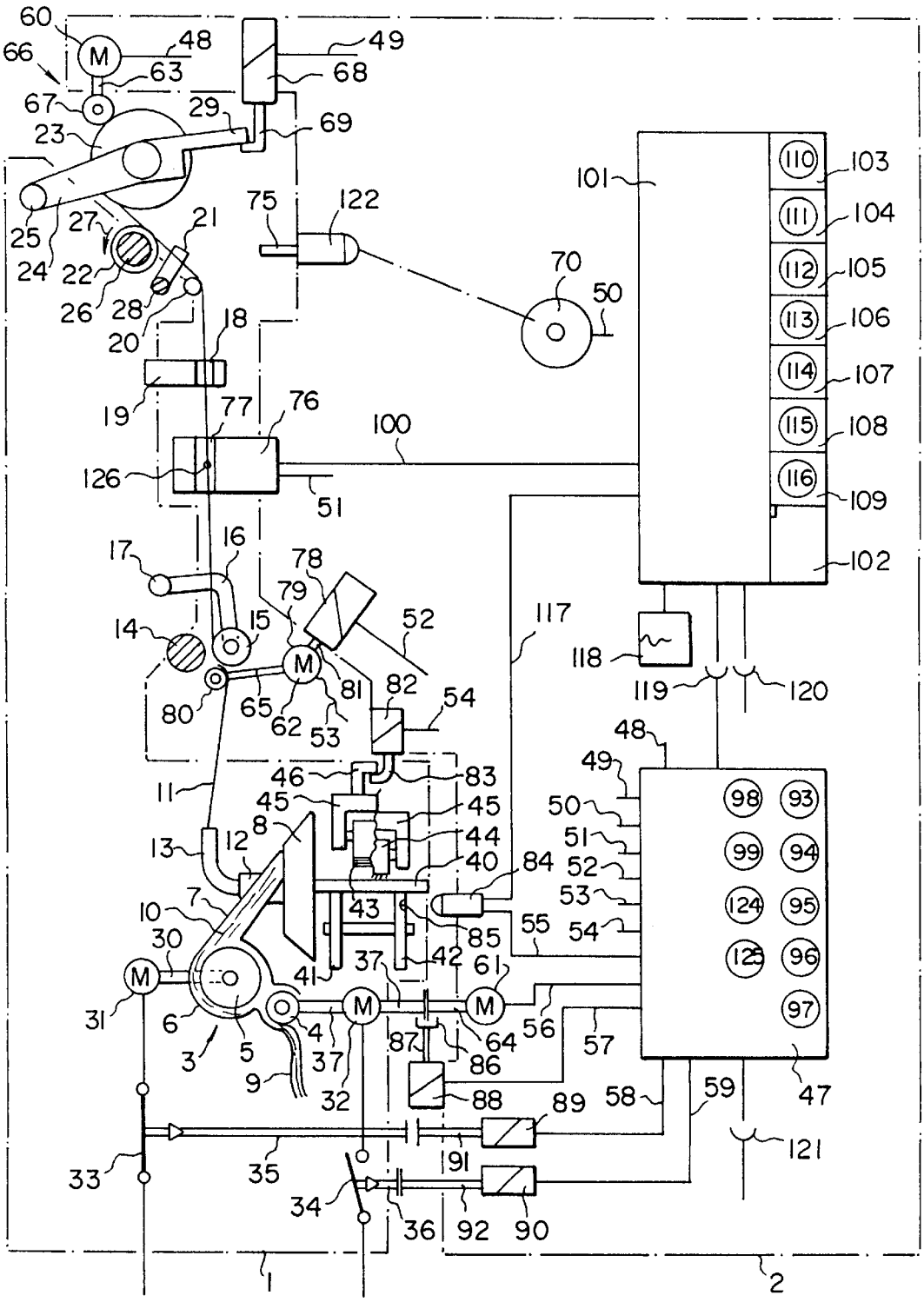
FIG. 2 is a view similar to FIG. 1 showing the apparatuses during measurement of the piecer.

During this time, the computer 47 causes the lifting of the cheese 23 from the take-up roller 22 and causes it to be pressed against the drive roller 67 of the bobbin drive device 66 of the piecing device 2, as FIG. 2 shows. To this end, the creel lifter 68 is actuated, which retracts its switch rod 69 and as a result pivots the creel 24 upward. The end of the thread 11 has run up onto the cheese 23. It must first be retrieved from there, optionally prepared for piecing in a non-illustrated manner by unraveling the end of the thread, and then moved in front of the mouth of the draw-off tube 13, from where it can be aspirated by vacuum prevailing later in the spinning device. To this end, the computer 47 causes the thread return device 70 to move the thread receiver 75 out of the position of repose shown in FIG. 2 to the suction position shown in FIG. 1. A housing 122 of the thread receiver 75 includes a non-illustrated device for generating a suction vacuum for this purpose. The housing 122 also includes a thread cutter, with which the aspirated end of the thread can be cut to a defined length.

During the aspiration of the end of the thread, the computer 47 causes the drive motor 60 to rotate the driver roller 67 backward for a certain period of time. As a result, the cheese 23 is driven to rotate backward, so that it can release the end of the thread. During that time, the computer 47 causes the thread return device 70 to move the thread receiver 75, with the aspirated thread, to the position 75'. In this process the mouth of the thread receiver 75 moves approximately along the travel line of the thread 11 shown in FIG. 1. Once the thread receiver 75 has reached the position 75', the drive motor 60 is turned off.

In this exemplary embodiment, the thread, i.e., the end of the thread that has run up onto the cheese 23, is moved in such a way upon being retrieved that the thread threads itself into the traversing thread guide 21, into the measurement slit 18 of the cleaner 19, and into the measurement slit 77 of the sensor 76. However, it does not enter in between the pair of draw-off rollers 14, 15. Instead, the thread travels behind the draw-off roller 80 of the draw-off device 79 of the automatic spinning apparatus 2.

In the course of cleaning the rotor 8, the program of the computer 47 may cause the opening cylinder 5 to be switched on again. Alternatively, the opening cylinder 5 may also not even be switched off but instead may be allowed to continue to rotate. This is the case in particular if a central drive for all of the opening cylinders of the machine is provided, for instance through the use of tangential belts. In order to ensure that an equalized tuft of fibers can be placed in front of the opening cylinder 5 at the end of the sliver 9 before the actual piecing operation, with this tuft having approximately the same shape for each piecing operation, the clutch apparatus 86 may be switched on by actuation of the electromagnetic drive mechanism 88 during cleaning of the rotor 8 by the computer 47, as a result of which the clutch disks 38 and 39 press against one another, thereby connecting the shaft 64 of the motor 61 to the shaft 37 of the switched-off motor 32. By briefly switching on the motor 61, the draw-off roller 4 can be made to execute one or more rotations during the cleaning work, in order to move the sliver 9 forward somewhat. The fibers that are combed out in this process are removed from the rotor 8 by suction. The coupling of the shafts 64 and 37 is then maintained. The opening cylinder 5 rotates at a rated rpm, after the switch device 89 has retracted its switch rod 91 and thereby turned the switch 33 back on again.

The actual piecing operation will be described below in further detail, while referring to FIG. 5.

Figure 5:
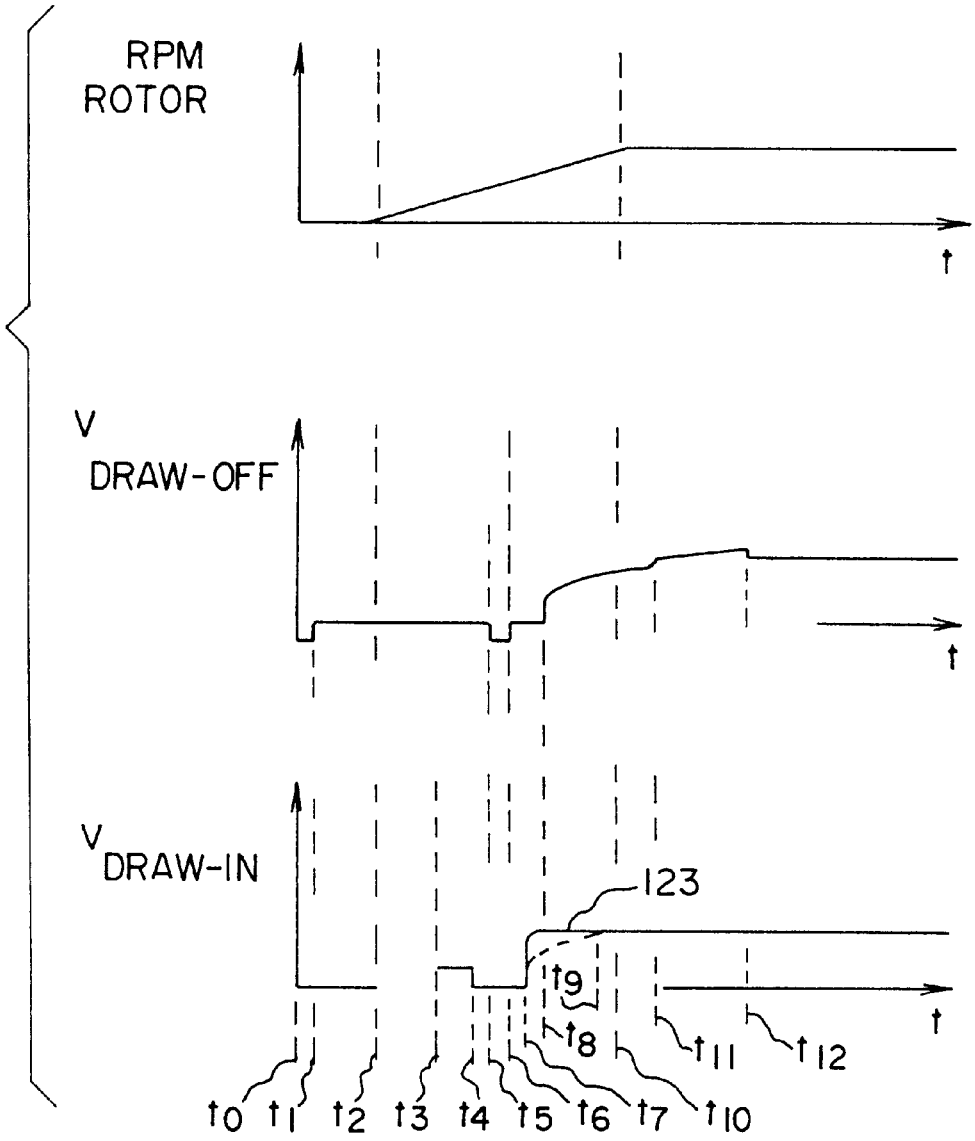
FIG. 5 is a set of diagrams showing the course over time of the automatic piecing.

FIG. 5 includes three diagrams disposed one above the other, showing the course of the rotor rpm at the top, the course of the draw-off speed in the center, and the course of the draw-in speed for the sliver at the bottom.

Before a time t0 is reached, the computer 47 causes the actuation of the electromagnetic drive mechanism 78 and thus the preparation of the draw-off device 79 for draw-in off the thread. The electromagnetic drive mechanism 78 retracts its control rod 81, as FIG. 2 shows. As a result, the draw-off roller 80 presses thread that is retrieved from the cheese 23 and moved in front of the mouth of the draw-off tube 13, against the contact roller 15. In this process, the bracket 16 of the contact roller 15 swivels upward somewhat about the pivot shaft 17, so that the contact between the draw-off roller 14 of the automatic spinner 1 and the contact roller 15 is lost. The draw-off device of the automatic spinner is made inoperative as a result, even through the draw-off roller 14 continues to rotate.

From the time t0 to a time t1, the computer 47 switches on the drive motors 60 and 62 in reverse gear. The result is a negative draw-off of thread. In other words, the end of the thread that is already released inside the draw-off tube 13 and aspirated by the negative pressure prevailing in the rotor 8 is moved closer to the spinning device 8, but without reaching the fiber collector groove of the rotor.

Shortly before a time t2 is reached, the computer 47 causes rotor run-up to start, by switching off the switch device 82. In this process, the switch rod 83 of the switch device 82 releases the yoke 45, so that the billy rollers 44 can press the running tangential belt 43 against the shaft 40 of the rotor 8. The pairs of support disks also then begin to rotate with the shaft 40, and the photoelectric barrier 84 begins to count the pulses of the reflector 85. The computer 47 is programmed in such a way that the further piecing control is activated when the second reflector pulse appears. The measuring channel 109 detects the acceleration, which is calculated from the time elapsed between the second and third counting pulses. The rotor acceleration is also ascertained in the same way in the computer 47. The appearance of the second reflector pulse is shown at the time t2 in FIG. 5. If the rotor 8 is already rotating at the time t0 for any reason at all, then a malfunction is occurring, which causes the piecing program to be stopped and may cause it to be repeated.

The computer 47 uses the rotor acceleration to ascertain a starting time t3 for prefeeding spinning fibers into the rotor 8, so that a ring of fibers can form in the collecting groove. The prefeeding lasts 230 ms and is ended at a time t4. The magnitude of the draw-in speed of prefeeding determines the quantity of fiber that reaches the rotor. For the sake of prefeeding, the piecing computer 47 causes the drive motor 61 to be switched on at the time t3 and off at the time t4. The instantaneous run-up of the prefeeding can be effected by a disk impeller motor. In order to provide an instantaneous slow down, a non-illustrated brake can additionally be used. The draw-in speed is oriented to the value set at the command or control value setter 97.

The piecing computer 47 also uses the ascertained rotor acceleration to calculate a time t5 of the beginning and the time t5 of the end of a further thread return, in which the end of the thread reaches the rotor groove and the fiber ring present there. To this end, the drive motor 62, which is likewise constructed as a disk impeller motor, is shifted to reverse for a suitable period of time.

Between times t6 and t7, the returned end of the thread has time to join with the fiber ring of the prefeeding spinning fibers, which is present in the rotor groove. At the time t7, the operational fiber feeding is started, by turning on of the motor 61. The draw-in speed is oriented to the value set at the command value setter 96. The run-up of the draw-in speed normally takes the course shown by a dashed line 123.

The dwell time of the thread in the rotor groove may be set at approximately 120 ms. Subsequently, at a time t8, the positive draw-off is started, due to the fact that the computer 47 causes the drive motor 62 to be switched on in the forward gear. After a steep run-up, the draw-off speed approximately follows the run-up of the rotor rpm, as shown in FIG. 5 and the yarn rotation is kept as constant as possible.

The beginning of thread draw-off takes place at an advantageous instantaneous rotor rpm ascertained by the computer 47. This in turn depends on the machine-set operating rpm of the spinning rotor and on the applicable rotor diameter, which is set at the command value setter 95. For instance, at a rotor operating speed of 100,000 rpm and a selected rotor diameter of 33 mm, the thread draw-off begins once the rotor has reached a speed of 70,000 rpm. At an operating rotor speed of 70,000 rpm and a selected rotor diameter of 46 mm, the thread draw-off begins, for instance, as soon as the rotor reaches approximately 50,000 rpm in its run-up.

If the draw-in quantity follows the thread draw-off speed upon run-up, the yarn undergoes no fluctuations in fineness after the formation of the piecer. This is the ideal case. The use of highly dynamic drive motors for the draw-in and thread draw-off helps to meet this goal.

Since the fiber flow itself only follows the draw-in speed with a delay, a draw-in addition provision is made in the program of the computer 47, which is operative between the times t7 and t9. At that time the draw-in speed does not follow the draw-off speed. Instead, it is rapidly run-up to the value set at the command value setter 99, which in this case matches the value for the operating draw-in speed set at the command value setter 96. The draw-in addition remains operative only over a draw-in length that matches the staple length of the sliver being used.

At the time t8, the bobbin drive device 66 is also put into operation by switching on the drive motor 60 in the forward gear. As a result, the thread 11 that is drawn off continuously by the draw-off device 79 is wound up onto the cheese 23 as is shown in FIG. 2.

After the run-up of the rotor 8 between times t11 and t12, the computer 47 causes the drive of the draw-in roller 4 to be transferred from the motor 61 to the motor 32 by switching off the switching device 90, which thereupon retracts the switch rod 92, so that the switch 34 closes automatically and turns on the motor 32. The electromagnetic drive mechanism is subsequently turned off, making the clutch apparatus 86 inoperative. The motor 61 is then turned off.

Between the times t11 and t12, the transfer of the drive of the cheese 23 from the drive roller 67 to the take-up roller 22 also occurs. To this end, first the motors 60 and 62 are shifted to a slightly elevated rpm, so that at the transfer there will be no drop in the thread draw-off speed. The transfer of the thread to the pair of draw-off rollers 14, 15 is carried out by switching off the electromagnetic drive mechanism 78, which makes the draw-off device 79 inoperative and causes the pair of rollers 14, 15 to take on the task of further draw-off. This happens at the time t12. The switchover of the bobbin drive is performed by turning off the creel lifter 68 having the switch rod 69 which accordingly releases the creel 24. The operating state of the automatic spinner 1 shown in FIG. 1 is then reached. Once the piecer computer 47 has brought about the return of the thread receiver 75 to the basic position shown in FIG. 2, the automatic piecing apparatus 2 can then be removed from the automatic bobbin winder 1, and moved to some other automatic bobbin winder of the same spinning machine, in order to perform the piecing that may be necessary there.

The beginning of rotor run-up is also communicated by the sensor 84 to the device 101, through the operative connection 117. This device thereupon activates the sensor 76. The sensor 76 may instead be activated by the computer 47 through the operative connection 51. The sensor 76 then supplies continuous measurement data to both the computer 46 and the device 101, approximately until the time t11. If an intolerably thick or thin place occurs, the computer 47 causes the stoppage of the piecing operation, and upon a second repetition it causes a new start. If the piecing is still unsuccessful after that, no further attempt at piecing is made, and the automatic spinner 1 is reported as malfunctioning. The limit of tolerance of a thick place can be set at a limit value setter 124 and the limit of tolerance for a thin place can be set at a limit value setter 125 on the computer 47. The command value that can be set at the command value setters 110 and 111 for thick places applies only to the lower limits, but not to the upper limits of the thick places that can be set at the limit value setter 124. The limit values for the thin places that can be set at the command value setters 112 and 113 of the counters 105 and 106 pertain to the maximum values, not to the minimum values for the thread diameter of a thin place that can be set at the limit value setter 125.

The event counters detect events that are located in the piece of thread upstream and downstream of the piecer 126 that is represented by a dot in FIG. 2, and that are related in some way to the piecer 126. The measurement distance extends from approximately 29 cm upstream of the piecer 126 to approximately 60 cm downstream of the piecer 126. Since the piecer 126 becomes perceptible as a result of characteristic sequences of thick and thin places, the measurement limits can also be set retroactively by the computer of the event counter 101. On the other hand, the beginning and end of measurements by the sensor 76 can also be ascertained from the detected beginning of rotor run-up and from the rotor acceleration, on which all of the various times of the piecing steps depend, and calculated by the computer of the device 101.

During the relatively brief measurement time, short and long thick places, short and long thin places, the diameter sequence of thick/thin/thick of a proper piecer, which is approximately one rotor groove circumference long, and some other sequence and/or length of thickness deviations, as an indication of an abnormal piecer, and the rotor acceleration, are all ascertained separately in the counters 103 to 109. Additionally, the rotor rpm and braking of the rotor until it stops can be detected. Thick places, thin places and their location with respect to the piecer are counted separately as special events and stored in the memory 102. The course of the rotor rpm and/or rotor acceleration can also be stored in memory, but may also optionally serve the purpose of analysis of the events being ascertained. The counter outcome is recorded and, for instance upon being called up, is output by the output unit 118, for instance in the form of a printed record.

In the simplest case, interpretation of the events is left to the user, who on the basis of the record makes suitable changes in the setting at the command value setters and limit value setters of the computer 47, or at the command value setters of the event counter 101, in order to vary the limit values there. If the rotor acceleration deviates from the command acceleration specified by the command value setter 116, then this is also weighted as an event, stored in memory, recorded as an event, and output when called up.

Through the use of the interface 119, and on the basis of the findings of the device 101, the device 101 is capable of exerting either direct or future influence on the piecing operation controlled by the piecing computer 47 and, for example, of automatically setting better command values and limit values.

Through the use of the interfaces 120 and 121, an external computer can support the work of both the event counters and the device 101 as well as the piecing computer 47. Variants of this kind will be described in further detail below.

Figure 4:
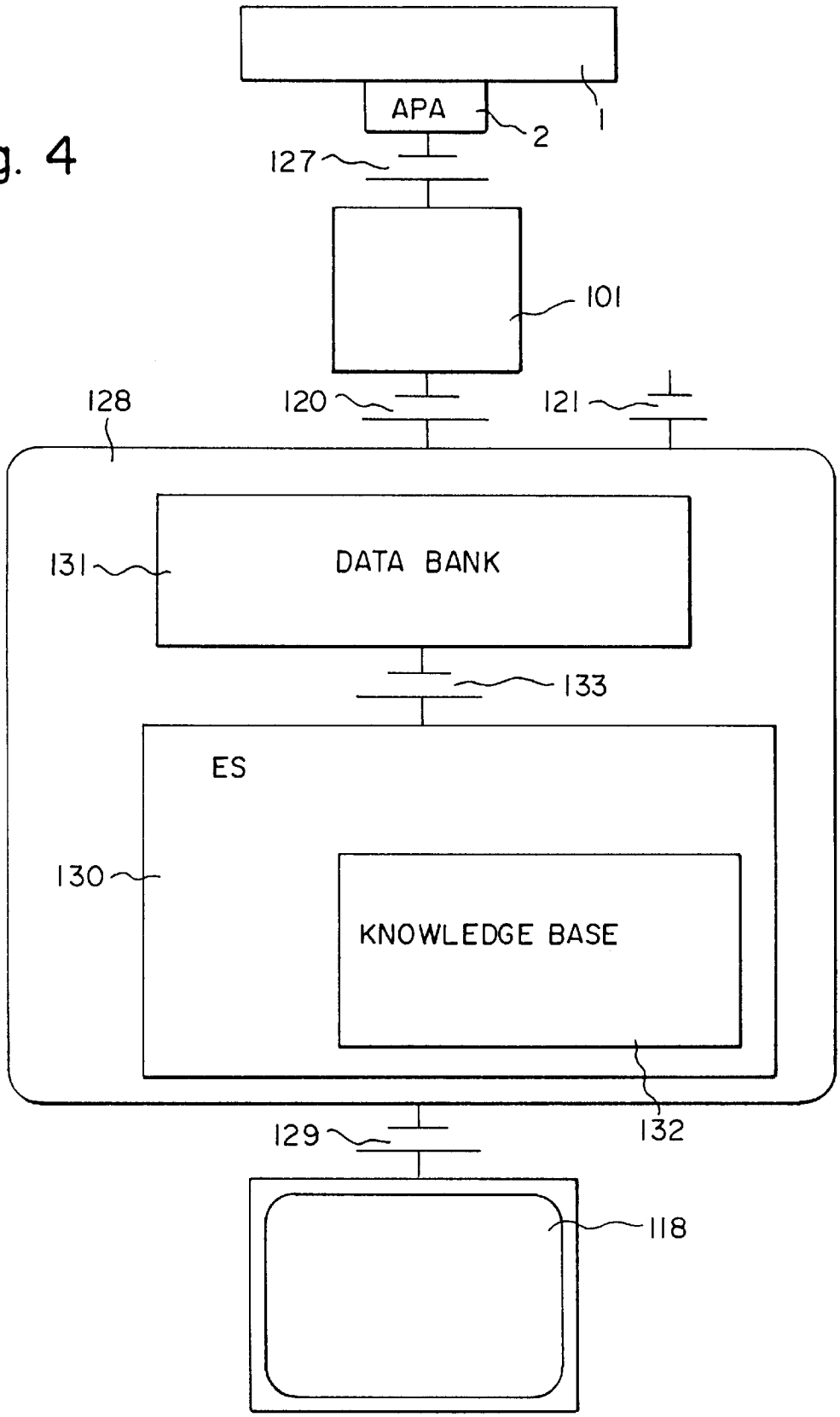
FIG. 4 is a block diagram of a system structure of an expert system in combination with an event counter.

In the embodiment of FIGS. 1 and 2, the event counters and the device 101 are integrated into the automatic spinning apparatus 2. Although this is practical, it is not absolutely necessary. In the block circuit diagram of FIG. 4, the corresponding automatic piecing apparatus 2 with the automatic spinner 1 is, for instance, connected to the device 101 containing the event counters, through an interface 127. In turn, the device 101 is connected to an external computer 128 through the interface 120. The external computer 128 is connected to the output unit 118 by means of an interface 129. The external computer 128 is also connected to the piecing computer 47 shown in FIGS. 1 and 2 through the interface 121.

The computer 128 contains a preprogrammed expert system 130 having a data bank 131 and a knowledge base 132. Through the use of an interface 133, the data bank 131 is connected to the expert system 130.

In order to link the events found by the event counter, the computer 128 is programmed in such a way that indications for varying the criteria of the piecing operation and/or for varying the parameters or command values, are arrived at from the outcome of the linkage, in accordance with the type and/or severity and/or frequency of one event in comparison with the type and/or severity and/or frequency of other events. Proposals for such variations can arrive through the interface 121 at the piecing computer 47, which optionally automatically performs such variations and displays them.

The computer 128 is also programmed in such a way that the measurement data pertaining to the run-up behavior of the spinning device 8 are used to evaluate the special events.

In its expert system 130, the computer 128 includes an analysis program for analyzing the events found for possible malfunctions or defects of the piecing apparatus 2 or of the piecing operation. The automatic weighting of the defects and malfunctions in accordance with their severity and/or their possible cause, and the finding and output of proposals for overcoming the malfunction or defect is provided, based on the defect analysis by the output unit 118. The expert system 130 takes into account the finding of a succession of possible sources of malfunction or defect, the preparation of proposals for overcoming the malfunction or defect, and the output of a list of proposals for overcoming defects based on the likelihood of success. Weighting of the likelihood of success in overcoming the malfunction or defect is performed in accordance with the expense entailed in terms of material, engineering, labor and/or time and is included in the program of the expert system 130. The output by the output unit 118 takes the form of a list that is both displayed and printed out.

Figure 3:
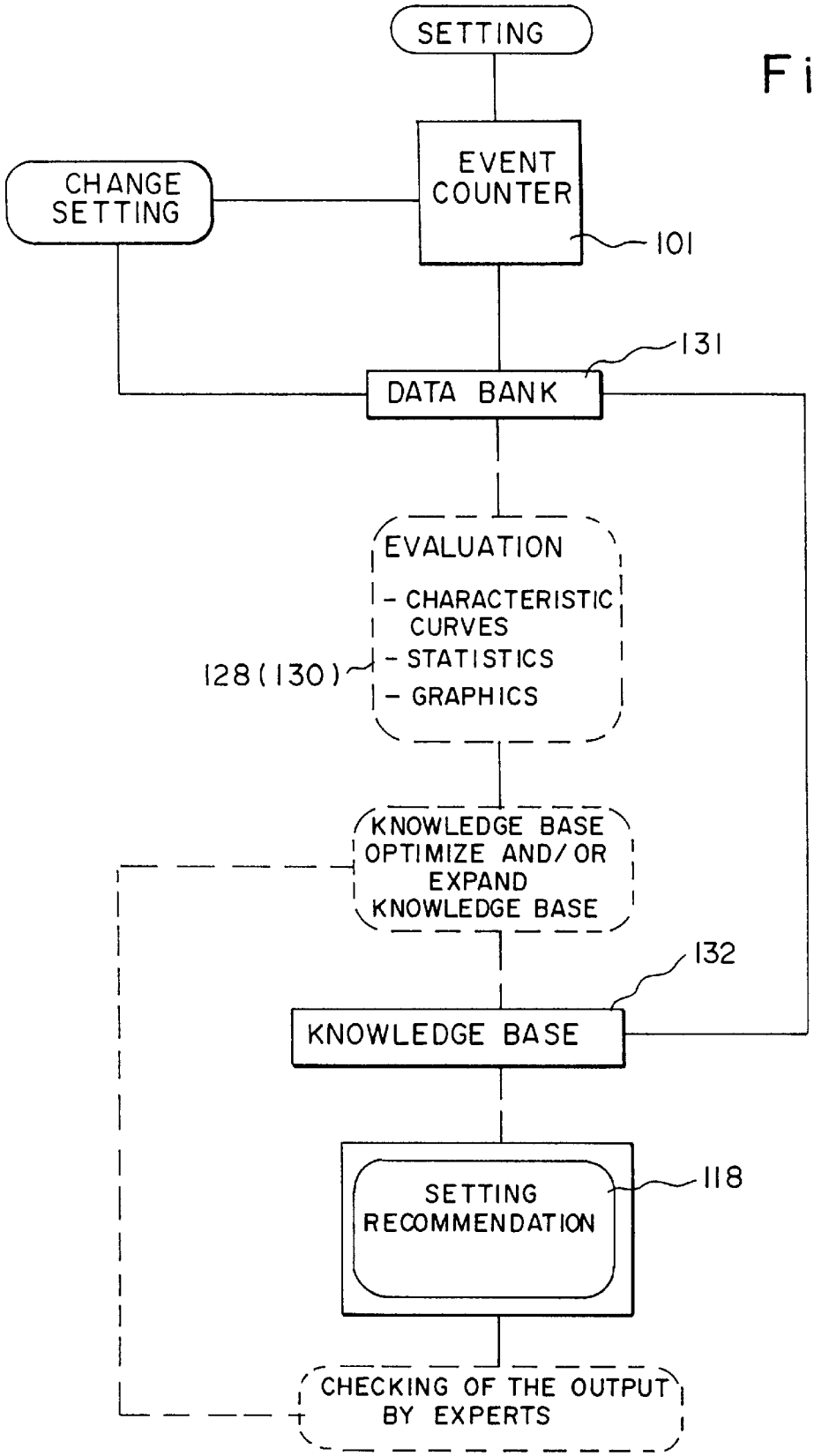
FIG. 3 is a flow chart used for data evaluation.

The flow chart shown in FIG. 3 summarizes the basic mode of operation of the expert system of the computer 128.

Once the command values and limit values determining the piecing operation are set, the device 101 already checks the events for possible changes in settings. The output of the device 101 is connected to the data bank 131 and the data bank 131 is connected to the knowledge base 132. In cooperation with the data bank and the knowledge base, the computer 128 performs the evaluation of the data, produces characteristic curves, statistics, and graphics, and makes proposals on optimizing and/or supplementing the knowledge base. It also issues recommendations on settings, which recommendations can in turn be checked by experts, as can the recommendations on optimizing and/or supplementing the knowledge base.

The expert system thus becomes increasingly effective, step by step, until finally optimal settings or setting recommendations for operation of the automatic piecing apparatus can be output for a wide range of particular applications.

We claim:

1. In a method for determining a variation in control data of an automatic piecing operation at an automatic piecing apparatus of an automatic spinner, which includes measuring diameters of thread in a length of thread in which a piecer is located and evaluating any deviations from a given thread diameter for improving the piecer, with at least one sensor disposed in a thread travel path, upon resumption of winding after a piecing operation in which a spun yarn is received, the improvement which comprises:

scanning a piece of thread containing the piecer by measuring with the at least one sensor in terms of location of a deviation from a given diameter with respect to the piecer at defined measurement points and obtaining measured data, as further criteria of the piecing operation;

continuously inputting the measured data obtained in the scanning step into event counters connected downstream of the at least one sensor;

evaluating and separately counting with the event counters the location of the deviations with respect to the piecer and specific sequences of deviations; and processing data obtained in the counting step and using the result of processing as a basis for varying control data of future automatic piecing operations.

2. The method according to claim 1, which comprises defining separately counted data counted in the counting step as events, and wherein the processing step comprises processing the data obtained in the counting step in a computer associated with the event counters, and comparing the separately counted events with regard to the type and severity and frequency of one event in comparison with the type and severity and frequency of other events; and using a result of the comparison in the basis for varying the control data of future piecing operations.

3. The method according to claim 2, which comprises detecting at least one working step characteristic for the piecing operation with a given sensor as a further criterion of the piecing operation; and wherein the processing step comprises processing measured data of the given sensor and using the measured data of the given sensor for evaluating the events.

4. The method according to claim 3, wherein the evaluating step comprises evaluating the events in the computer and analyzing the events for possible defects and malfunctions in accordance with a suitable, predetermined analysis program; automatically weighting the defects in accordance with their severity and possible causes of malfunction and defect; and additionally automatically ascertaining and outputting proposals for overcoming the malfunction or defect based on the defect analysis.

5. The method according to claim 4, wherein the evaluating step further comprises ascertaining a succession of possible causes of malfunction and defect for each defect and each malfunction; weighting at least one proposal for each ascertained possible cause of the malfunction and defect, for overcoming the malfunction and defect in terms of its likelihood of success and the expense it entails in terms of material, engineering, labor and time; and automatically outputting with the computer a weighting-ordered list of the possible defects and malfunctions and proposals for overcoming the malfunction and defect.

6. The method according to claim 2, wherein the evaluating step comprises evaluating the events in the computer and analyzing the events for possible defects and malfunctions in accordance with a suitable, predetermined analysis program; automatically weighting the defects in accordance with their severity and possible causes of malfunction and defect; and additionally automatically ascertaining and outputting proposals for overcoming the malfunction or defect based on the defect analysis.

7. The method according to claim 6, wherein the evaluating step further comprises ascertaining a succession of possible causes of malfunction and defect for each defect and each malfunction; weighting at least one proposal for each ascertained possible cause of the malfunction and defect, for overcoming the malfunction and defect in terms of its likelihood of success and the expense it entails in terms of material, engineering, labor and time; and automatically outputting with the computer a weighting-ordered list of possible defects and malfunctions and proposals for overcoming the malfunction and defect.

8. The method according to claim 2, which comprises outputting the result of the comparison in a useful form on a display unit connected to the computer.

9. In an apparatus for determining a variation of control data for an automatic piecing operation in an automatic piecing apparatus of an automatic spinner, including at least one sensor disposed in a thread travel path for measuring a diameter of the thread in a length of thread in which the piecer is located for improving future piecers, upon a resumption of a winding operation after a piecing operation, the improvement comprising event counters receiving measurement data from the at least one sensor, a measured value processing device associated with said event counters and having a computer and at least one memory; command value setters for setting measurement limits of said event counters, said event counters including means for issuing counter results regarding variously profiled deviations in diameter, sequences of the deviations and a location of at least one of the deviations with respect to the piecer; and means for separately storing the counter results in memory and means for recalling the counter results from memory and for processing the results as information regarding piecing operations having elapsed previously, an using process results as a basis for possibly necessary variations for improving the control data for future automatic piecing operations.

10. The apparatus according to claim 9, including means for connecting a control computer of the automatic piecing apparatus to said event counters and a display unit for displaying the counter results.

11. The apparatus according to claim 9, wherein said measured value processing device includes means programmed to link the counter results and issue results of linking from which indications for varying the control data of the piecing operation in accordance with the type, severity and frequency of one event in comparison with the type, severity and frequency of other events.

12. The apparatus according to claim 9, including another sensor for detecting a behavior of a spinning device of the automatic spinner during an acceleration of the spinning device; said other sensor being connected to said measured value processing device; and said measured value processing device being programmed for using the measured data on the behavior during acceleration being received for evaluating the measurement data from said at least one sensor.

13. The apparatus according to claim 9, including means for connecting one of said event counter and said measured value processing device to an external computer for coprocessing with said measured value processing device.

14. The apparatus according to claim 9, wherein said computer has an analysis program for analyzing the counter results with respect to possible defects and malfunctions of one of the piecing apparatus and of the piecing operation; and a program provides weighting of the defects and malfunctions in accordance with their severity and their possible cause and provides proposals for overcoming the malfunction and defect on the basis of the defect analysis.

15. The apparatus according to claim 14, wherein the program of said computer provides a list of possible sources of a malfunction and a defect, prepares proposals for overcoming the malfunction and defect, and lists proposals for overcoming the malfunction and defect in accordance with a likelihood of success.

16. The apparatus according to claim 15, wherein the program of said computer provides the weighting of the likelihood of success of overcoming the malfunction and defect in accordance with an expense entailed in terms of at least one of material, engineering, labor and time.

17. The apparatus according to claim 9, wherein said computer contains a preprogrammed expert system with a data bank and a knowledge base.

18. Method for determining advantageous changes in spinning data for a piecing operation performed by an automatic piecing apparatus at an automatic spinner, which comprises:

piecing a thread with a piecer in an automatic piecing apparatus;

subsequently measuring different types of data, with a sensor disposed in a yarn travel path, on a piece of yarn containing the piecer, the different types of data including deviations from a given yarn diameter, a location of the deviations relative to the piecer, a profile of the deviations and a sequence of the deviations;

providing event counters respectively associated with the different types of measured data connected downstream of the sensor;

continuously inputting the measured data into the respective event counters;

evaluating the measured data in a data processing device for obtaining processed data; and optimizing spinning data for subsequent piecing operations on the basis of the processed data.

* * * * *